US005101547A

United States Patent [19]

Tanaka et al.

[11] Patent Number: 5,101,547

[45] Date of Patent: Apr. 7, 1992

[54] METHOD AND SYSTEM FOR MANUFACTURING SUPERALLOY DISK

[75] Inventors: Shoji Tanaka, Kakogawa; Yukio Nishiyama, Akashi; Yasutaka Toya, Nara; Masaru Nishiguchi, Ashiya, all of Japan

[73] Assignees: Kawasaki Jukogyo Kabushiki Kaisha, Hyogo; Sumitomo Metal Industries, Ltd., Osaka, both of Japan

[21] Appl. No.: 618,305

[22] Filed: Nov. 21, 1990

Related U.S. Application Data

[63] Continuation-in-part of Ser. No. 500,542, Mar. 28, 1990, abandoned.

[30] Foreign Application Priority Data

Mar. 28, 1989 [JP] Japan ..... 1-77121

[51] Int. Cl.[5] ..... B22D 13/00; B23P 23/00

[52] U.S. Cl. ..... 29/526.3; 29/33 C; 29/527.5; 164/114

[58] Field of Search ..... 29/527.2, 527.5, 527.6, 29/526.3, 33 C; 164/114

[56] References Cited

U.S. PATENT DOCUMENTS

Re. 31,767 12/1984 Brooks ..... 29/527.2
2,871,578 2/1959 Tarmann et al. ..... 29/527.5
3,175,287 3/1965 Pashak ..... 29/527.5
3,599,314 8/1971 Harrison et al. ..... 29/527.6 X
3,823,764 7/1974 Schmitz ..... 164/114 X
3,857,167 12/1974 Schmitz ..... 29/527.5 X

FOREIGN PATENT DOCUMENTS 294666 4/1971 U.S.S.R. ..... 29/526.3
1264512 2/1972 United Kingdom ..... 164/114

*Primary Examiner*—Carl J. Arbes
*Attorney, Agent, or Firm*—Wenderoth, Lind & Ponack

[57] ABSTRACT

A superalloy disk to be utilized for a rotating body of an aircraft or turbine engine is manufactured by a casting mold provided with a cavity having an inner shape for forming a disk. A molten bath of superalloy melted under a vacuum or an inert gas atmosphere is poured into the casting mold under a vacuum or an inert gas atmosphere and the casting mold with the molten bath is stirred so as to prepare a rough casting of fine crystal grains by applying an external force such as an eccentric centrifugal force. The thus produced disk material may be heated thereafter. The rough casting is formed of crystal grains less than 100 μm in diameter, and a rate of strain during the rotational forging is less than $10^0$/sec. amd more than $10^{-2}$/sec.

10 Claims, 5 Drawing Sheets

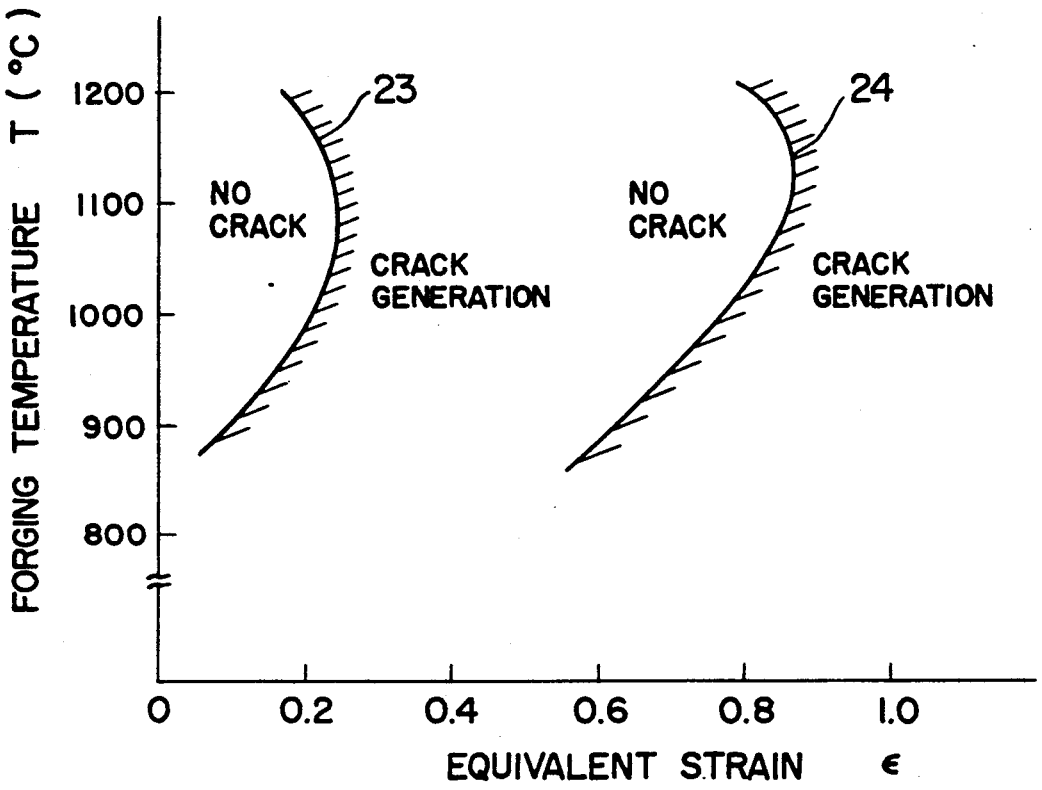
FIG. 6
FIG. 7A
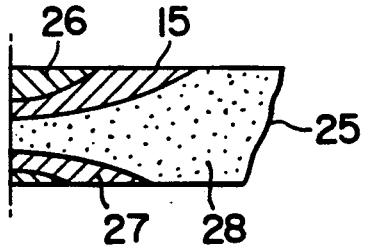
FIG. 7B
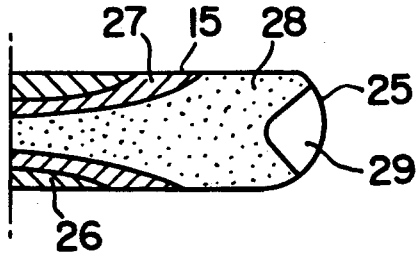

METHOD AND SYSTEM FOR MANUFACTURING SUPERALLOY DISK

This application is a continuation-in-part of U.S. Ser. No. 07/500,042 filed Mar. 28, 1990 and now abandoned.

BACKGROUND OF THE INVENTION

The present invention relates to a method and apparatus for manufacturing superalloy disks to be particularly utilized for rotating body members of aircraft or power generation gas turbine engines in which highly improved fuel consumption efficiency is desired.

In conventional disc material technology, a nickel (Ni) base superalloy manufactured by forging a cast ingot is utilized for a turbine disk of an aircraft or a power generation gas turbine engine. However, in compliance with the recent technological requirements for highly improved performance of gas turbine engines with improved thermal efficiency, increased speed and reduced weight, it has been imperative to increase a volume ratio of $\gamma'$ precipitation phase in a structure of a turbine disk material. The tendency of this increase of the volume ratio has resulted in the increase of deformation resistance of turbine disk materials at high temperatures, a reduction in the forgeability of ingots, and an increase of segregation. For these and other reasons, it has become extremely difficult to forge and form a turbine disk having a complicated shape.

K. Iwai et al. in "Mechanical Properties of Ni-base Superalloy Disks Produced by Powder Metallurgy" (R-D KOBE STEEL ENGINEERING REPORTS, Vol. 37, No. 3, 1987, pp. 11–14) teaches a good example of a technique for solving the difficulty described above involving a near net shape working method by an isothermal forging means. This working method, as shown in FIG. 8, comprises the steps of producing fine powders from a molten material of a predetermined alloy composition by a gas atomizing method utilizing an Ar gas (step 40), and forming a billet by a hot extrusion or hot isostatic pressuring (hereinafter called "HIP") application (steps 41 to 44) so that solidified fine powders should exhibit a superplastic characteristic during a forging cycle at a low rate such as a strain of $2\times10^{-4}$/sec. (step 45). The temperatures of the billet and a mold are maintained at a constant temperature such as 1100° C. in the forging cycle so as to obtain a product having a near net shape. Finally, heat treatment is carried out (step 46).

However, the conventional isothermal forging method described above involves the following defects or drawbacks.

(1) Low Productivity

The described method utilizes the isothermal forging method characterized by low rate of strain working as a method for improving the deformability, so that the working time is extremely long, resulting in low productivity. A lubricant for the mold is exposed at high temperature conditions for such a long time that the mold is extremely degraded.

(2) Too Many Manufacturing Steps

It is necessary to make the material into fine powders for minimizing segregation of elements and enabling the isothermal deformation, and therefore, the powder canning step (41) and the HIP or hot extrusion preforming step (42 or 43) are required. The need for these additional steps, of course, gives rises to additional equipment costs.

(3) Difficulty in Quality Control

Severe control is required for preventing the powder surface and a surface from the oxidation of foreign substances from intruding into the casing, which requires much labor for securing the reliability of the method.

(4) High Manufacturing Cost

The prolonged processing time in the HIP process in the third step 42 and the isothermal forging process in the fifth step 45 requires much energy, which results in the lowering of the productivity, the increase of the equipment cost and the increase of the maintenance cost, and therefore the increase of the manufacturing cost.

SUMMARY OF THE INVENTION

An object of the present invention is to substantially eliminate the defects or drawbacks encountered in the prior art described above and to provide a method and apparatus for manufacturing a superalloy disk having improved performances with high productivity, high yields and reduced cost, in comparison with a disk made by the conventional isothermal forging method.

According to the present invention this and other objects can be achieved by providing a method of manufacturing a superalloy disk comprising two independent novel processes. The first of these processes is the making of a rough casting by providing a casting mold defining an inner cavity corresponding in shape to a disk, pouring a molten metal of a superalloy melted under a vacuum or an inert gas atmosphere into the casting mold under a vacuum or inert gas atmosphere, stirring the mold until the molten metal poured therein solidifies by, for example, applying an external eccentric centrifugal force so as to facilitate the formation of fine crystal grains. The second novel process is a rotational forging process to forge the rough casting, and which forging can be carried out much easier than the conventional isothermal forging process is employed. The forged blank may be heat-treated thereafter. The two processes described above are quite independent of each other. The grain-refining casting process is a novel process superior to that of the conventional isothermal forging process as described hereinafter. The disk described above can be fabricated by employing the two processes in combination.

More particularly, the disk can be manufactured according to the present invention by two independent and novel apparatus in accordance with the simplified block diagram shown in FIG. 1. One apparatus is a casting apparatus for manufacturing a superalloy rough casting which comprises a driving means provided with a turntable, a casting device mounted on the turntable (the casting device including a casting mold mounted to be eccentrically rotated on a mold setting table actuated by the driving means), an inner cylindrical member placed around the mold, an outer cylindrical member mounted on the mold setting table (the inner cylindrical member being supported by the outer cylindrical member through spring means). The other apparatus is a forging apparatus including a forging mold comprising lower and upper mold halves and a driving means for rotating the mold halves.

According to the superalloy disk manufacturing method and apparatus described above, the rough casting is grain-refined by applying an irregular external force such as the eccentric centrifugal force to molten metal in the mold. According to such processes, the segregation of alloying elements can be reduced and therefore the rough casting can exhibit excellent forgeability and high forging yield. Namely, high deformation resistance at high temperatures due to the segregation of alloying elements and the coarsening of crystal grains which are typically difficult to prevent in a usual cast ingot can be significantly reduced. In order to attain these effects, an eccentric centrifugal stirring casting method under a vacuum or an inert gas atmosphere is employed to prepare a superalloy material (rough casting) of fine crystal grains. By using such a rough casting, it becomes substantially easier to forge a superalloy material with extremely high strength at high temperatures.

On the other hand, as a method of forging powder pancakes or grain-refined materials similar to those described above, an isothermal forging method is usually applied in which the material is heated at as high of a temperature as the mold. In fact, the material described above can be forged with substantial difficulty even by the above method. However, the inventors of the present application found from various considerations and experiments that the rotational forging method is far better for forging the material described above than the conventional isothermal forging method. By adapting the rotational forging method, the ductility of the grain refined castings is dramatically improved due to the dynamic recrystallization during the forging process, and consequently the material is more easily deformed to a disk having nearly a net shape than in the case of the conventional isothermal forging method. Namely, according to the forging method, the material is uniformly deformed, the working limit is expanded, and even better, the material can be forged with a smaller forging force than in the conventional isothermal forging method.

The forging according to the present invention may be further improved when the rough casting is grain-refined preferably to less than 100 μm in diameter, and a rate of strain during the rotational forging is being $10^0$ /sec. and $10^{-2}$/sec.

BRIEF DESCRIPTION OF THE DRAWINGS

In the accompanying drawings:

FIG. 6 is a graph showing a hot deformability;

FIGS. 7A and 7B show the difference of equivalent strain distributions due to the difference in the forging methods.

DETAILED DESCRIPTION OF THE PREFERRED EMBODIMENT

Figure 1:
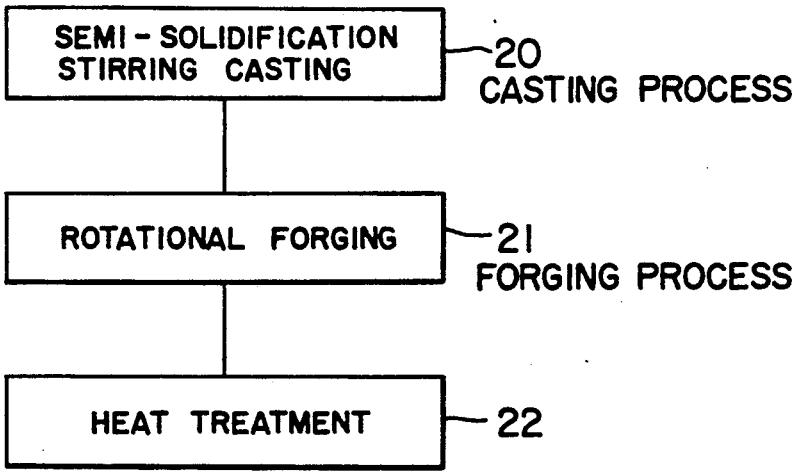
FIG. 1 is a brief flowchart showing the superalloy disk manufacturing processes according to the present invention.
Figure 8:
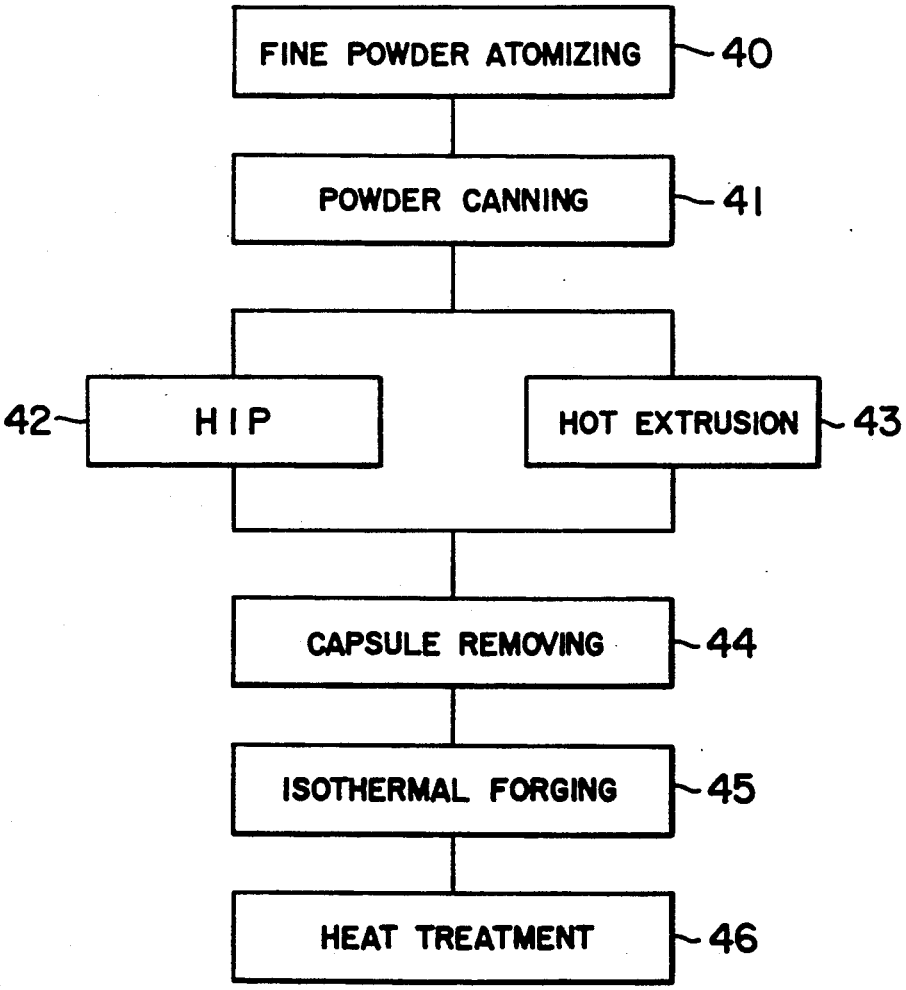
FIG. 8 PRIOR ART
FIG. 8 is a brief flowchart showing a superalloy disk manufacturing method in the prior art.

As shown in FIG. 1, the present invention generally comprises the steps of semi-solidification stirring casting 20 by using an eccentric centrifugal force, rotational forging 21 and heat treatment 22. The first two major processes above will be specifically described hereinunder.

Figure 2:
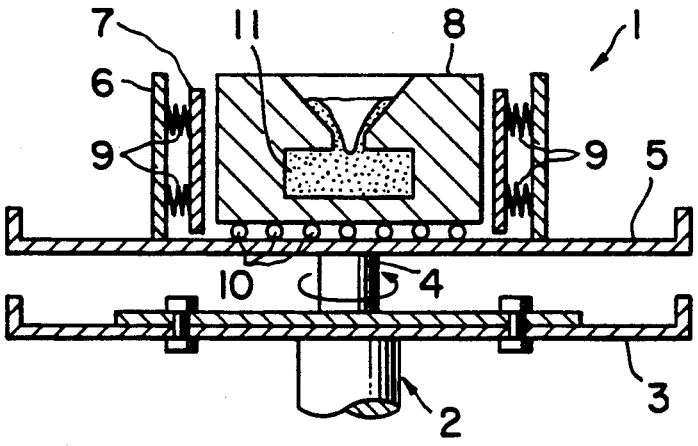
FIG. 2 is a cross-sectional view of a casting apparatus according to the present invention.
Figure 3:
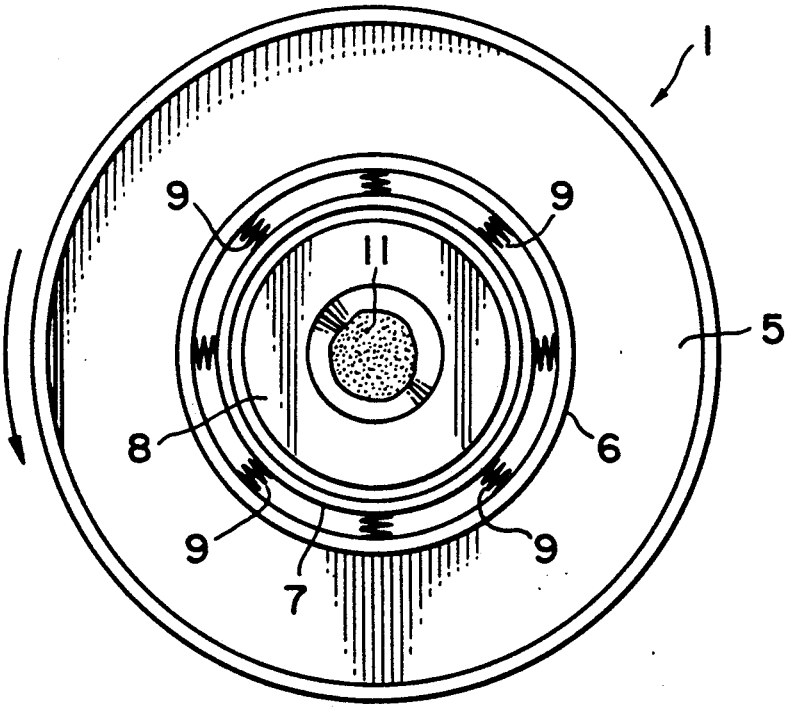
FIG. 3 is a plan view of the casting apparatus.

FIGS. 2 and 3 show one example of casting apparatus according to the present invention. A casting apparatus 1 for superalloy is mounted on a turntable 3 fixed on a rotating device 2, and comprises a rotating shaft 4 concentrically mounted on the turntable 3, a mold setting table 5 secured to the upper end of the rotating shaft 4 for supporting a mold, outer and inner cylindrical members 6 and 7 disposed on the table 5, and a mold (casting mold) 8 supported on the table 5 through a number of steel balls 10 inside the inner cylindrical member 7. The outer cylindrical member 6 is secured at the upper surface of the table 5 and the inner cylindrical member 7 is supported by the outer cylindrical member 6 through a plurality of springs 9 secured at respective ends to the outer and inner peripheral surfaces of the inner and outer cylindrical members 7 and 6. Thus, the inner cylindrical member 7 is supported to be movable horizontally in a floating manner.

The grain refined superalloy is cast by utilizing the above-explained casting apparatus 1 in the following manner. The melting and casting processes are performed under a vacuum or an inert gas atmosphere in a closed chamber 19 which is connected with a vacuum unit through a joint 17.

A superalloy molten bath 11 is poured in the mold 8. Any profile of the cavity of the mold 8 may be selected. A casting temperature of the molten bath should be as low as possible within the castable temperature range. After the molten bath has been poured into the mold 8, the rotating device 2 is immediately driven to rotate the entire casting apparatus 1 with a rotating speed preferably about 60 to 250 r.p.m. (and typically 180 r.p.m.). The rotation of the casting apparatus 1 moves the mold 8 disposed on the steel balls 10 by the eccentric centrifugal force in an extremely random and complicated sort of manner. Thus, the molten bath 11 in the mold 8 can be stirred and agitated strongly and uniformly. Accordingly, the semi-solidification stirring effect is continuously applied to the molten bath 11 and the growing crystal grains are effectively broken and refined, whereby the segregation of the alloying elements can be reduced and rough casting with excellent forgeability can be obtained with high manufacturing yield.

Figure 4:
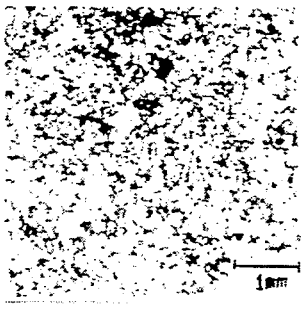
FIG. 4 is a microscopic photograph showing the macro-structure of superalloy obtained by an eccentric centrifugal semi-solidification casting method.

According to the casting method of the character described above, the crystal grains are substantially refined by the combination of the cooling effect of the molten bath 11 due to the low pouring temperature and metal mold, and the eccentric centrifugal stirring effect. The structure of a casting thus obtained exhibits, as shown in FIG. 4, extremely fine crystal grains smaller than 100 μm in diameter and, has an improved forgeability at high temperatures. In this example the material is Inconel 792+Hf; the pouring temperature was 1308° C., and the speed of rotation of the mold was 180 r.p.m. In addition, according to the casting method, the surface of the molten bath 11 solidifies immediately after the pouring operation and therefore the inside of the molten bath remains half-solidified, so that harmful oxides floating on the surface of the molten bath are hardly mixed into the interior of a casting during the subsequent stirring stage. A sound element can be provided.

Next, referring to FIG. 5, the forging apparatus 12 for forging the above-described refined casting will be described. The forging apparatus 12 comprises a lower mold 13 and an upper mold 14 locked on an upper plate 18, both made of a heat resisting alloy, such as an Mo alloy, and material 15 to be forged (rough forging) is interposed between the molds 13 and 14. Under this state, the molds 13 and 14 are rotated at predetermined rotating speeds (typically 20~50 r.p.m.) In such a manner that the lower mold 13 is rotated about a central axis $O_1$ and the upper mold 14 is rotated about an axis $O_2$ inclined by angle $\alpha$ with respect to the axis $O_1$, while applying pressure in a direction indicated by arrow A through the upper plate 18. An annular induction heating coil means 16 is arranged around the molds 13 and 14 to heat the molds and the material interposed therebetween over the forging cycle. The angle $\alpha$ can be changed by selecting an appropriate inclination (angle $\alpha$) of the lower surface of upper plate 18, and the strain rate defined as V/Ho (V: moving speed of the upper plate 18, Ho: height of specimen before forging) can be changed by adjusting the moving speed V.

When the rough casting 15 to be forged is compressed by rotating the forging apparatus 12 under a high temperature condition, the rough casting 15 is more easily deformed than when using the conventional isothermal forging method. Namely, according to experiments carried out by the inventors of the present application, as shown in FIG. 6 showing the relationship between an equivalent strain $\epsilon$ and a forging temperature T in isothermal or rotational forging, the condition of "no crack" in the case of isothermal forging is shown in the lefthand area of the boundary 23, whereas the condition of "crack generation" is shown in the righthand area of the boundary 23 where the equivalent strain $\epsilon$ is defined as ⌈ −log e H/Ho, H: height of specimen after forging, Ho: height of specimen before forging ⌋. On the other hand, by practicing the rotational forging method of the present invention, the forgeable boundary 24 can be expanded further to the right. In the experiments, an Iconel 792+Hf material specimen (25 mm in diameter×25 mm in height) having fine crystal grains was utilized as a test article and the strain rate was fixed at $1.5\times10^{-2}$ sec$^{-1}$.

The results of the above experiments will be described as follows. FIG. 7 shows a difference in the strain distribution due to the different forging methods. In FIG. 7A showing a rotational forged particle, the working effect reached as far as the outer peripheral free surface 25 of the casing 15. On the other hand, as shown in FIG. 7B, in the conventional isothermal forging method, the working effect does not reach as far and consequently, the structure near the free surface remains unforged. Accordingly, in the case of FIG. 7B, a crack is produced near the free surface 25 of the material 15. In FIG. 7, the areas 26, 27, 28 and 29 show ranges in which the equivalent strains $\epsilon$ are of more than 0.8%, 0.5 to 0.8%, 0.2 to 0.5%, and less than 0.2%, respectively.

One preferred concrete example of a turbine disk for a gas turbine engine according to the present invention will be described hereunder.

EXAMPLE

As a test article, Ni-based superalloy of Inconel 100 and Iconel 792+Hf having predetermined compositions described later were utilized. The test articles were cast by the semi-solidification stirring method by utilizing the apparatus shown in FIGS. 2 and 3 (pouring temperature: 1308° C., rotational speed of mold: 180 r.p.m.) to produce, according to the present invention, two kinds of products (1 and 2) of Inconel 792+Hf and Inconel 100 having grain sizes of about 100 μm (ASTM grain degree No. 4~5). On the other hand, as comparative products 1*a* and 1*b*, rough castings (Inconel 792+Hf) were prepared by other conventional casting methods (unstirring) in which the crystal grain degrees were set to ASTM grain degree Nos. of 0~1 and 1~5. The chemical composition of the Iconel 100 are Cr: 12.4, Co: 18.5, Mo: 3.2, Al: 5.0, Ti: 4.3, V: 0.8, Zr: 0.06, B: 0.02, C: 0.07, and Ni: balance by wt %. The chemical composition of Inconel 792+Hf are Cr: 12.4, Co: 8.9, Mo: 1.8, W: 4.4, Ta: 4.0, Ti: 3.9, Zr: 0.05, Hf: 0.09, B: 0.01, C: 0.12, and Ni: balance by wt %. Both materials were cast under a high vacuum pressure condition of $10^{-4}$ Torr using a mold made of cast iron. The final articles were produced by separating the riser portions from the castings.

Figure 5:
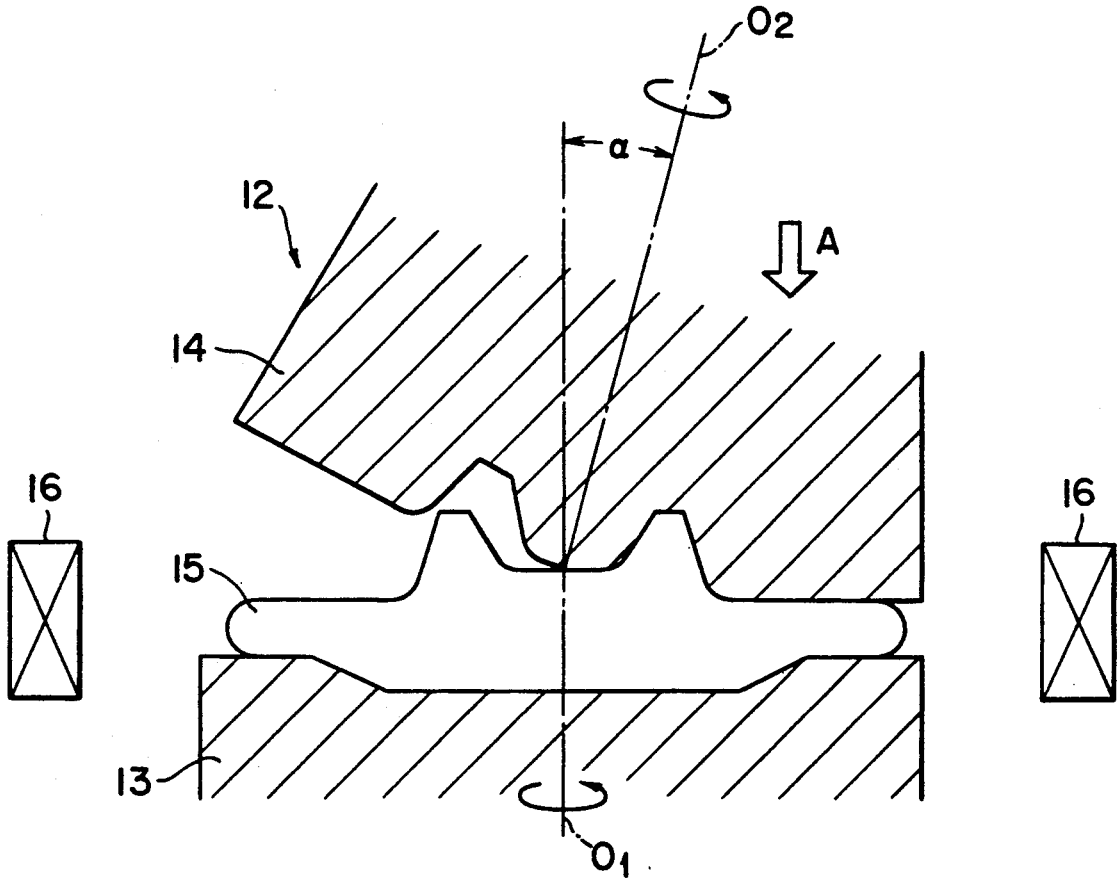
FIG. 5 is a schematic view of the structure of a rotational forging apparatus.

The test articles preheated thereafter by an electric furnace to a temperature of about 1100° C. were forged by the rotational forging method utilizing the apparatus shown in FIG. 5. The forging method was performed under the condition in which the upper and lower molds 13 and 14 were preliminarily heated to a temperature of about 600° to 1000° C. and the preheated test articles were set in the preheated mold and then worked by the rotational forging method.

Various experiments were carried out by the inventors of the present application on the four test articles prepared by the methods described above in order to observe the forgeability under different forging conditions and the results of these experiments are shown in Table 1. It will be apparent from Table 1 that the cast material (rough casting) of fine crystal grains according to the present invention is effective for improving the forgeability and that the forgeability depends on the strain rate $\epsilon$ even with the grain-refined material of the present invention.

TABLE 1

| Test Piece | Grain Size ASTM No. | Forging Temperature °C. | Angle α° | Equivalent Strain ε | Strain Rate ε sec$^{-1}$ | | | | |
|---|---|---|---|---|---|---|---|---|---|
| | | | | | $5\times10^{-2}$ | $10^{-2}$ | $10^{-1}$ | $10^{0}$ | $5\times10^{0}$ |
| No. 1 | 4~5 | 1040 | 3.5 | 0.80 | Large Local Crack | No Crack | No Crack | No Crack | Large Crack |
| No. 1a | 0~1 | 1040 | 3.5 | 0.80 | Large Crack | Small Crack | Small Crack | Small Crack | Large Crack |
| No. 1b | −1~−5 | 1040 | 3.5 | 0.80 | Large Crack | Small Crack | Small Crack | Large Crack | Large Crack |
| No. 2 | 4~5 | 1040 | 3.5 | 0.86 | Large Local Crack | No Crack | No Crack | No Crack | Large Crack |

Namely, the products 1 (No. 1) and 2 (No. 2) of the present invention show better results than the comparative articles 1a and 1b (Nos. 1a and 1b) at the strain rate $\epsilon$ between $10^{\circ}$ and $10^{-2}$. In this range of the strain rate, it is possible to carry out near net-shaped forging.

Experiments were further performed by using Inconel 792+Hf material to observe the tensile properties (Room Temperature) of an unforged cast disk and a forged disk prepared by the above mentioned method (heat treatment: 1180° C.×2 hours aircool, 860° C.×4 hours aircool, 760° C.×16 hours aircool), and the results are shown in Table 2. From the Table 2, it will be clear that the strength as well as the elongation can be improved by employing the rotational forging process, and the properties are nearly equal to those of the powder forged materials.

TABLE 2

| | Tensile Strength ($kg/mm^2$) | Elongation (%) |
|---|---|---|
| Fine Grain Cast + Rotational Forged Material | 152.1 | 12.3 |
| Fine Grain Cast Material | 128.7 | 6.4 |

As described hereinbefore with reference to the preferred example, according to the present invention, the semi-solidification stirring effect due to the eccentric centrifugal force can be continuously imparted to the molten bath and simultaneously the rough casting can be nearly net-shaped while being grain refined, whereby the segregation of alloying elements can be minimized. Thus, the rough casting exhibiting excellent forgeability can be produced with high yield. The ductility and deformability of the rough casting can be improved by applying grain refined castings together with the rotational forging method.

It is to be understood by persons skilled in the art that the present invention is not limited to the described preferred embodiment and many other alternative forms of the invention may be employed without departing from the spirit and scope of the appended claims.

What is claimed is:

1. A method of manufacturing a superalloy disk, said method comprising the steps of:

providing a casting mold defining a cavity therein for forming a rough casting;

melting a superalloy under a vacuum or an inert gas atmosphere;

pouring the molten superalloy into the casting mold under a vacuum or an inert gas atmosphere;

stirring the mold with the molten superalloy poured therein so as to produce a rough casting of fine crystal grains; and forging the thus obtained rough casting by rotating a tool over the rough casting so as to obtain a forged blank.

2. The method according to claim 1, wherein said steps of melting, pouring and stirring are carried out in a manner to produce a rough casting formed of crystal grains less than 100 $\mu$m in diameter.

3. The method according to claim 1, wherein a rate of strain during the step of forging step is controlled to be less than $10^0$ /sec. and more than $10^{-2}$/sec.

4. The method according to claim 1, wherein the step of stirring comprises applying an external force to the casting mold by subjecting the mold to an eccentric centrifugal rotating mode.

5. The method according to claim 1, further comprising the step of heating the forged blank.

6. A system for manufacturing a supperalloy disk, said apparatus comprising:

a turntable;

turntable driving means, on which said turntable is supported, for rotating said turntable;

a casting device mounted on the turntable, said casting device including a mold-supporting table rotatable by the driving means, a casting mold mounted on said table so as to be rotated therewith, an inner cylindrical member disposed around said casting mold and supported on said mold-supporting table so as to be movable in a horizontal direction, and an outer cylindrical member mounted on said mold-supporting table around the inner cylindrical member, said inner cylindrical member being supported by said outer cylindrical member through a spring in a floating manner; and a forging device operatively associated with said casting device and including a forging mold comprising a pair of mold halves, and forging mold driving means for rotating said mold halves.

7. A system according to claim 6, wherein said casting mold defines a cavity therein in a shape corresponding to a disk.

8. A system according to claim 6, wherein said forging mold driving means controls said forging mold to impart a rate of strain of less than $10^0$ /sec. and more than $10^{-2}$/sec.

9. A system according to claim 6, wherein one of said mold halves is supported in the apparatus for rotation about an axis thereof and the other one of said mold halves is supported in the apparatus for rotation about an axis thereof at an inclination with respect to the axis of rotation of said one of the mold halves.

10. A system according to claim 6, further comprising an annular induction heating coil means, disposed around said lower and upper mold halves, for heating said mold halves.

* * * * *